US005570674A

United States Patent [19]

Izumiura et al.

[11] Patent Number: 5,570,674

[45] Date of Patent: Nov. 5, 1996

[54] EVAPORATIVE EMISSION CONTROL SYSTEM FOR INTERNAL COMBUSTION ENGINES

[75] Inventors: Atsushi Izumiura; Takashi Isobe; Hiroshi Yatani, all of Wako, Japan

[73] Assignee: Honda Giken Kogyo Kabushiki Kaisha, Tokyo, Japan

[21] Appl. No.: 562,368

[22] Filed: Nov. 22, 1995

[30] Foreign Application Priority Data

Nov. 25, 1994 [JP] Japan ..... 6-315668

[51] Int. Cl.[6] ..... F02M 25/08; F02D 41/22

[52] U.S. Cl. ..... 123/690; 123/520; 123/698

[58] Field of Search ..... 123/520, 690, 123/698

[56] References Cited

U.S. PATENT DOCUMENTS 5,195,498 3/1993 Siebler et al. ..... 123/520 X 5,427,075 6/1995 Yamanaka et al. ..... 123/520

FOREIGN PATENT DOCUMENTS 2-26754 2/1990 Japan .

*Primary Examiner*—Tony M. Argenbright

*Attorney, Agent, or Firm*—Nikaido, Marmelstein, Murray & Oram LLP

[57] ABSTRACT

An evaporative emission control system for an internal combustion engine has a purge control valve arranged in a purging passage connecting between a canister and an intake passage of the engine. The evaporative emission control system has a self-diagnosis function of determining whether the evaporative fuel emission control system is normal or abnormal from a change in a value of a parameter measured based on an output from an exhaust gas component concentration sensor arranged in an exhaust passage of the engine, which change is detected when the opening of the purge control value is changed, and a variation in pressure within the intake passage at a location downstream of a throttle valve arranged therein when the opening of the purge control valve is changed.

10 Claims, 11 Drawing Sheets

EVAPORATIVE EMISSION CONTROL SYSTEM FOR INTERNAL COMBUSTION ENGINES

BACKGROUND OF THE INVENTION

1. Field of the Invention

This invention relates to an evaporative emission control system for internal combustion engines, which has a self-diagnosis function of determining whether the system is normal.

2. Prior Art

An evaporative emission control system is conventionally provided for internal combustion engines, which is generally constructed such that evaporative fuel generated in a fuel tank is adsorbed in a canister for temporary storage therein, and the stored evaporative fuel is fed into the intake pipe at a location downstream of a throttle valve in the intake pipe when the engine is in a predetermined operating condition. An evaporative emission control system of this kind has been proposed e.g. by Japanese Laid-Open Utility Model Publication (Kokai) No. 2-26754, which includes a purge control valve arranged in a purging passage connecting between the canister and the intake pipe and a vacuum switch arranged in the purging passage at a location between the purge control valve and the canister. The proposed emission control system has a self-diagnosis function of determining whether the system is normal, i.e. whether purging of evaporative fuel is being normally carried out (this determination will be referred to as "the purge flow check") based on a change in the output from the vacuum switch when the purge control valve is opened and closed.

However, the proposed system is disadvantageous in that its manufacturing cost is increased due to the employment of the vacuum switch and it is incapable of accurately carrying out the purge flow check if the vacuum switch per se has low reliability.

SUMMARY OF THE INVENTION

It is an object of the invention to provide an evaporative emission control system for internal combustion engines, which is capable of carrying out the purge flow check with enhanced reliability without using a vacuum switch, thereby reducing the number of component parts and hence the manufacturing cost.

To attain the above object, the present invention provides an evaporative emission control system for an internal combustion engine having a fuel tank, an intake passage, a throttle valve arranged in the intake passage, an exhaust passage, an exhaust gas component concentration sensor arranged in the exhaust passage for detecting concentration of a component in exhaust gases emitted from the engine, air-fuel ratio control means for controlling an air-fuel ratio of a mixture supplied to the engine by the use of an air-fuel ratio correction coefficient determined in response to an output from the exhaust gas component concentration sensor, the evaporative emission control system including a canister for adsorbing evaporative fuel generated from the fuel tank, a purging passage connecting between the canister and the intake passage at a location downstream of the throttle valve, and a purge control valve arranged in the purging passage for controlling a flow rate of purged gases containing evaporative fuel to be supplied from the canister via the purging passage into the intake passage.

The evaporative emission control system according to the invention is characterized by comprising determining means for determining whether the evaporative fuel emission control system is normal or abnormal, from a change in a value of a parameter depending upon the output from the exhaust gas component concentration sensor detected when an opening of the purge control valve is changed and a change in pressure within the intake passage at a location downstream of the throttle valve when the opening of the purge control valve is changed.

In one preferred embodiment of the invention, the exhaust gas component concentration sensor is an O2 sensor which generates a binary signal in response to concentration of oxygen present in the exhaust gases, and the parameter is an evaporative fuel-dependent correction coefficient having a value thereof set in dependence on the air-fuel ratio correction coefficient for correcting the air-fuel ratio correction coefficient to compensate for influence of purging of the evaporative fuel on the air-fuel ratio correction coefficient.

Preferably, the determining means determines that the evaporative emission control system is normal when the evaporative fuel-dependent correction coefficient is smaller than a predetermined reference value when the engine is in a predetermined operating condition.

More preferably, the evaporative fuel-dependent correction coefficient is progressively decreased when a present value of the air-fuel ratio correction coefficient is smaller than a predetermined value smaller than a learned value of the air-fuel ratio correction coefficient, a change in an opening of the throttle valve is larger than a predetermined negative value, and at the same time a present value of the air-fuel ratio correction coefficient is decreasing.

Further preferably, the evaporative fuel-dependent correction coefficient is set such that it does not become smaller than a predetermined lower limit value before a predetermined time period elapses after the purging of evaporative fuel is started.

In another preferred embodiment of the invention, the exhaust gas component concentration sensor is a linear output air-fuel ratio sensor which generates an output signal proportional to concentration of oxygen present in the exhaust gases, and the parameter is a difference between a present value of the air-fuel ratio correction coefficient and an average value of the air-fuel ratio correction coefficient.

More preferably, the determining means determines that the evaporative emission control system is normal when the difference between the present value of the air-fuel ratio correction coefficient and the average value of the air-fuel ratio correction coefficient is larger than a predetermined reference value when the engine is in a predetermined operating condition during purging of the purged gases through the purge control valve.

More preferably, the determining means determines that the evaporative emission control system is normal when the pressure within the intake passage has increased by a predetermined amount or more, after the purge control valve was fully opened when the engine is in a predetermined operating condition.

More preferably, the determining means determines that the evaporative emission control system is abnormal when the pressure within the intake passage has not increased by a predetermined amount or more, within a predetermined time period after the purge control valve was fully opened when the engine is in a predetermined operating condition.

More preferably, the determining means inhibits execution of determination of abnormality of the evaporative emission control system when the pressure within the intake passage has decreased by a predetermined amount or more, after the purge control valve was fully opened when the engine is in a predetermined operating condition.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof.

Figure 1:
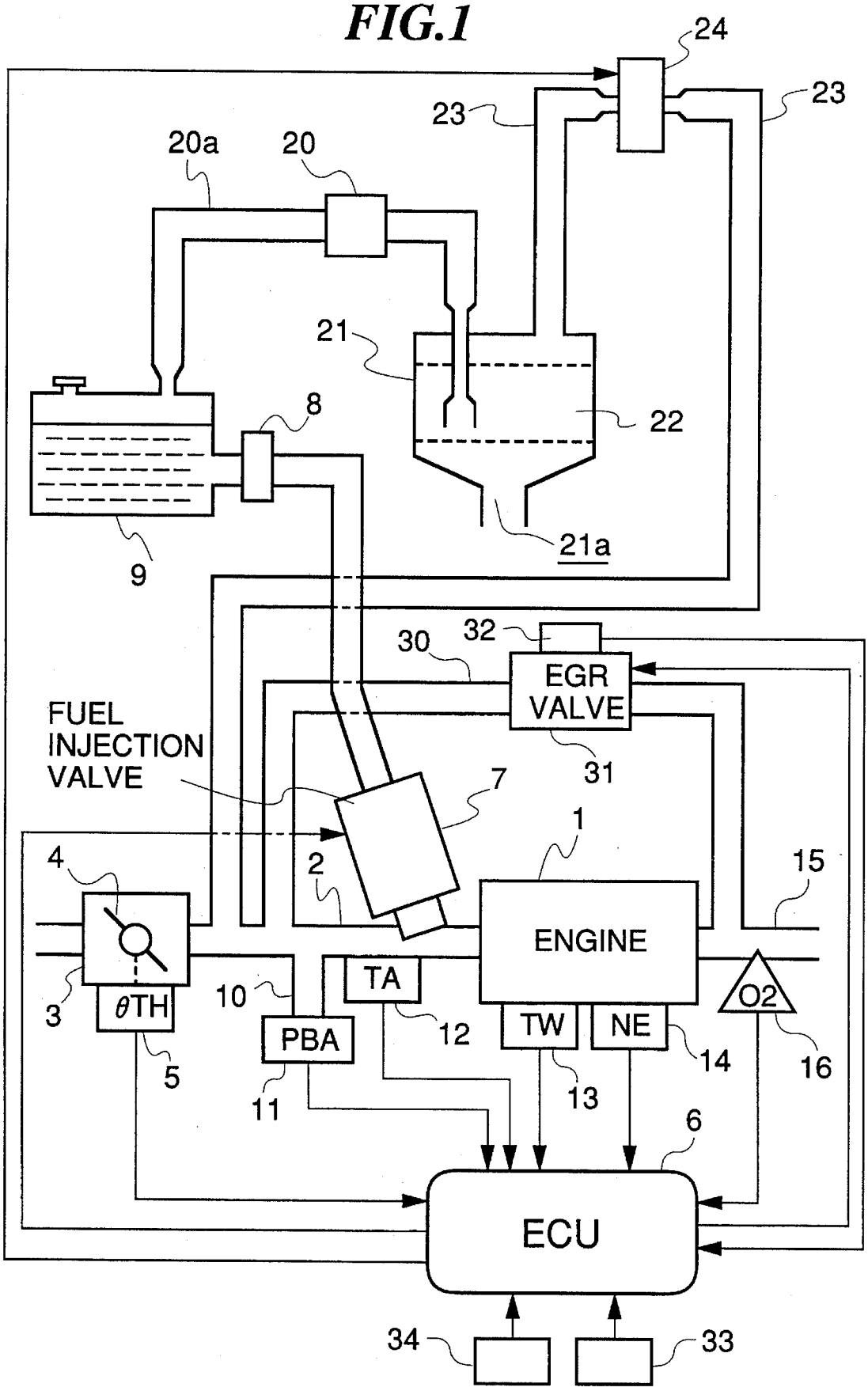
FIG. 1 is a block diagram showing the whole arrangement of an internal combustion engine incorporating an evaporative emission control system according to an embodiment of the invention.

Referring first to FIG. 1, there is shown the whole arrangement of an internal combustion engine (hereinafter simply referred to as "the engine") which incorporates an evaporative emission control system according to an embodiment of the invention. In the figure, reference numeral 1 designates an internal combustion engine for automotive vehicles. Connected to the cylinder block of the engine 1 is an intake pipe 2 in which is arranged a throttle valve body 3 accommodating a throttle valve 4 therein. A throttle valve opening (θTH) sensor 5 is connected to the throttle valve 4 for generating an electric signal indicative of the sensed throttle valve opening θTH and supplying same to an electronic control unit (hereinafter referred to as "the ECU") 6.

Fuel injection valves 7, only one of which is shown, are inserted into the interior of the intake pipe 2 at locations intermediate between the cylinder block of the engine 1 and the throttle valve 4 and slightly upstream of respective intake valves, not shown. The fuel injection valves 7 are connected to a fuel tank 9 via a fuel pump 8, and electrically connected to the ECU 6 to have their valve opening periods controlled by signals therefrom.

An intake pipe absolute pressure (PBA) sensor 11 is provided in communication with the interior of the intake pipe 2 at a location immediately downstream of the throttle valve 4 via a conduit 10, for supplying an electric signal indicative of the sensed absolute pressure within the intake pipe 2 to the ECU 6.

An intake air temperature (TA) sensor 12 is inserted into the intake pipe 2 at a location downstream of the intake pipe absolute pressure sensor 11 for supplying an electric signal indicative of the sensed intake air temperature TA to the ECU 6. An engine coolant temperature (TW) sensor 13, which may be formed of a thermistor or the like, is mounted in the cylinder block of the engine 1, for supplying an electric signal indicative of the sensed engine coolant temperature TW to the ECU 6.

An engine rotational speed (NE) sensor 14 is arranged in facing relation to a camshaft or a crankshaft of the engine 1, neither of which is shown. The engine rotational speed sensor 14 generates a pulse as a TDC signal pulse at each of predetermined crank angles whenever the crankshaft rotates through 180 degrees, for supplying the same to the ECU 6.

An O2 sensors 16 as an exhaust gas component concentration sensor is mounted in an exhaust pipe 15 extending from the cylinder block of the engine 1, for sensing the concentration of oxygen present in exhaust gases emitted from the engine 1 and supplying an electric signal indicative of the sensed oxygen concentration value to the ECU 6. Further, a vehicle speed sensor 33 and an atmospheric pressure sensor 34 are electrically connected to the ECU 6 for detecting the speed of a vehicle on which the engine is installed and atmospheric pressure, respectively, and supplying respective signals indicative of the detected vehicle speed and atmospheric pressure to the ECU 6.

A passage 20*a*, with one end thereof opening in the top of an air-tight fuel tank 9, connects the fuel tank 9 to a canister 21. The canister 21 is connected via a purging passage 23 to the intake pipe 2 at a location downstream of the throttle valve 4. The canister 21 contains an adsorbent 22 for adsorbing evaporative fuel generated from the fuel tank 9, and has an air inlet port 21*a* formed therein. A two-way valve 20 comprised of a positive pressure valve and a negative pressure valve is arranged in the passage 20*a*, while a purge control valve 24 formed by an electromagnetic valve of a duty-control type is arranged in the purging passage 23. The purge control valve 24 is provided with a solenoid, not shown, and connected to the ECU 6 to have its valving operation controlled by a duty control signal therefrom, whereby the ratio of the valve opening period to the valve closing period of the purge control valve is linearly changed by the duty control signal from the ECU 6. The passage 20*a*, the two-way valve 20, the canister 21, the purging passage 23 and the purge control valve 24 constitute the evaporative emission control system.

With the above arrangement of the evaporative emission control system, evaporative fuel generated within the fuel tank 9 forces the positive pressure valve of the two-way valve 20 to open when the pressure built up thereby reaches a predetermined level, and flows through the two-way valve 20 into the canister 21 to be adsorbed by the adsorbent 22 contained therein. The purge control valve 24 is driven to vary its valve opening by the duty control signal from the ECU 6. When the purge control valve 24 is open, evaporative fuel stored in the canister 21 is drawn into the intake pipe 2 via the purge control valve 24 together with fresh air introduced through the air inlet port 21*a* of the canister 21, to be supplied to the cylinders. When the fuel tank 9 is cooled by cold ambient air so that negative pressure is developed therein, the negative pressure valve of the two-way valve 20 is opened to return evaporative fuel temporarily stored in the canister to the fuel tank 9. Thus, the evaporative fuel generated within the fuel tank 9 is prevented from being emitted into the atmosphere.

An exhaust gas recirculation passage 30 is arranged between the intake pipe 2 and the exhaust pipe 15 in a fashion bypassing the engine 1. The exhaust gas recirculation passage 30 has one end thereof connected to the exhaust pipe 15 and the other end thereof connected to the intake pipe 2 at a location downstream of the throttle valve 4. An exhaust gas recirculation (EGR) control valve 31 is arranged in the exhaust gas recirculation passage 30 for controlling the amount of exhaust gases to be recirculated.

The exhaust gas recirculation control valve 31 is formed by an electromagnetic valve having a solenoid which is connected to the ECU 6 to have its valve opening linearly changed by a control signal from the ECU 6. The exhaust gas recirculation valve 31 is provided with a lift sensor 32 for detecting the valve opening thereof and supplying an electric signal indicative of the sensed valve opening to the ECU 6.

The ECU 6 determines operating conditions of the engine based on engine operating parameters including those detected by the above sensors, and supplies the solenoid of the exhaust gas recirculation control valve 31 with a control signal such that the difference between a valve opening command value LCMD calculated for controlling the exhaust recirculation control valve 31 based on the intake pipe absolute pressure PBA and the engine rotational speed NE and an actual valve opening value LACT of the exhaust recirculation control valve 31 detected by the lift sensor 32 becomes equal to zero.

The ECU 6 is comprised of an input circuit, not shown, having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), not shown, a memory device, not shown, storing various operational programs which are executed in the CPU **5*b*, and for storing results of calculations therefrom, etc., and an output circuit, not shown, which outputs driving signals to the fuel injection valves 7, the purge control valve 24, and the exhaust gas recirculation control valve 31**.

The CPU **5*b* operates in response to the above-mentioned signals from the sensors to determine various operating conditions in which the engine 1 is operating, such as an air-fuel ratio feedback control region in which the air-fuel ratio is controlled in response to the detected oxygen concentration in the exhaust gases detected by the O2 sensor 16, and open-loop control regions other than the air-fuel ratio feedback control region, and calculates, based upon the determined operating conditions, the valve opening period or fuel injection period TOUT over which the fuel injection valves 7 are to be opened, the duty factor of the duty control signal supplied to the purge control valve 24, and the valve opening command value LCMD for the exhaust gas recirculation control valve 31**.

Fuel injection via the fuel injection valves 7 is carried out in synchronism with generation of each TDC signal pulse over the fuel injection period TOUT calculated by the use of the following equation (1):

$$TOUT=TI\times KO2\times KEVAP\times K1+K2 \quad (1)$$

where TI represents a basic value of the fuel injection period TOUT, which is determined from a TI map stored in the memory device of the ECU 6 in accordance with the engine rotational speed NE and the intake pipe absolute pressure PBA.

KO2 represents an air-fuel ratio feedback control correction coefficient whose value is determined in response to the output from the O2 sensor 16 during the air-fuel ratio feedback control, while it is set, during the open-loop control, to predetermined values appropriate for respective open-loop control regions.

KEVAP represents an evaporative fuel-dependent correction coefficient for correcting the air-fuel ratio correction coefficient KO2 to compensate for the influence of purged evaporative fuel upon the coefficient KO2. The correction coefficient KEVAP is set to 1.0 while purging of evaporative fuel is not carried out, and to a value within a range of 0 to 1.0 during execution of the purging such that it is set to a smaller value as the influence of purged evaporative fuel is larger.

K1 and K2 represent other correction coefficients and correction variables, respectively, which are calculated based on various engine operating parameter signals to such values as to optimize operating characteristics of the engine such as fuel consumption and driveability, depending on operating conditions of the engine.

The CPU of the ECU 6 supplies, through the output circuit thereof, the fuel injection valves 7 with driving signals corresponding to the calculated fuel injection period TOUT determined as above, over which the fuel injection valves 7 are opened, and the purge control valve 24 and the exhaust gas recirculation control valve 31 with respective driving signals (i.e. the duty control signal and the control signal) to control the opening/closing thereof.

Figure 2A:
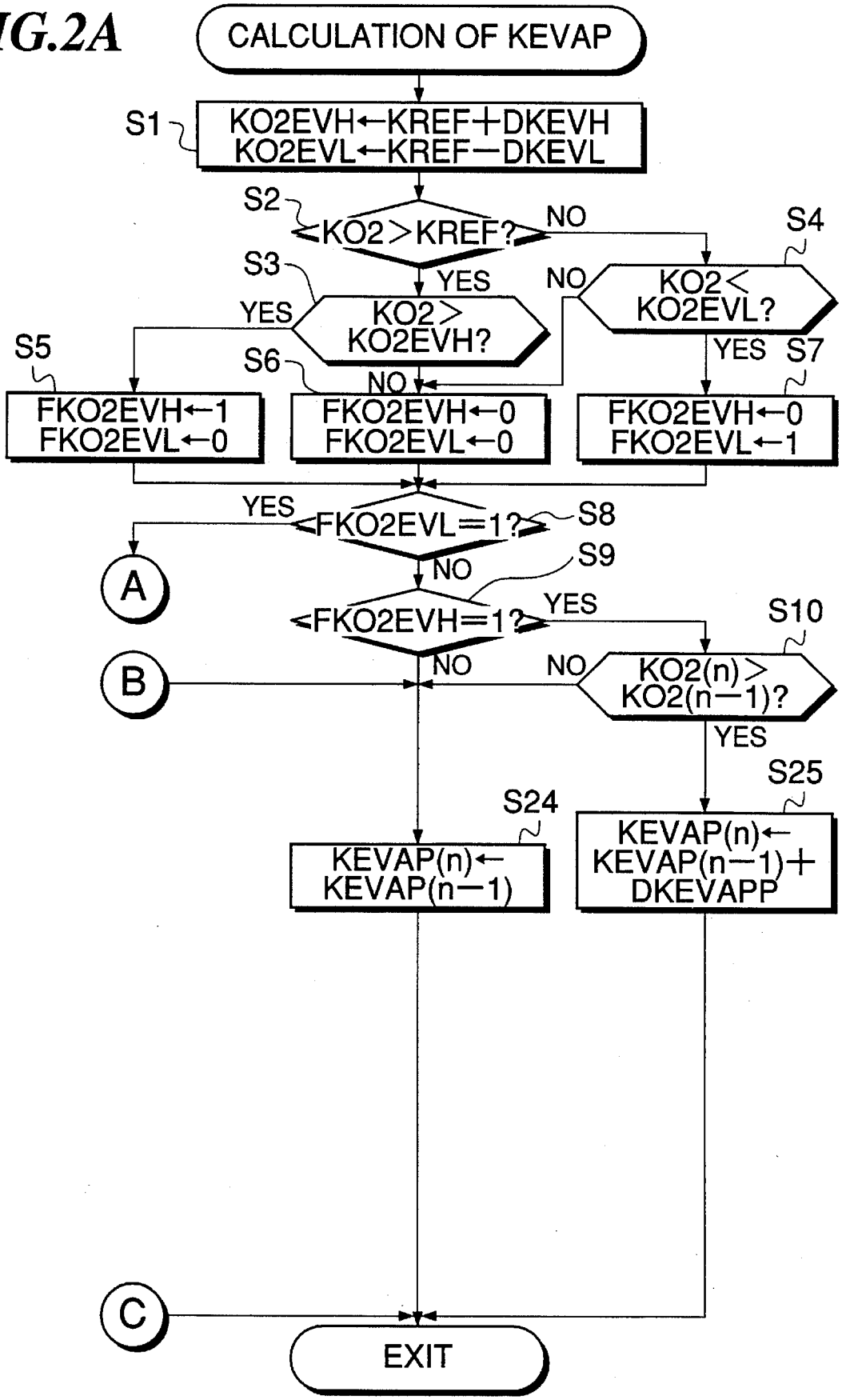
FIG. 2 is a flowchart showing a routine for calculating an evaporative fuel-dependent correction coefficient (KEVAP)
Figure 2B:
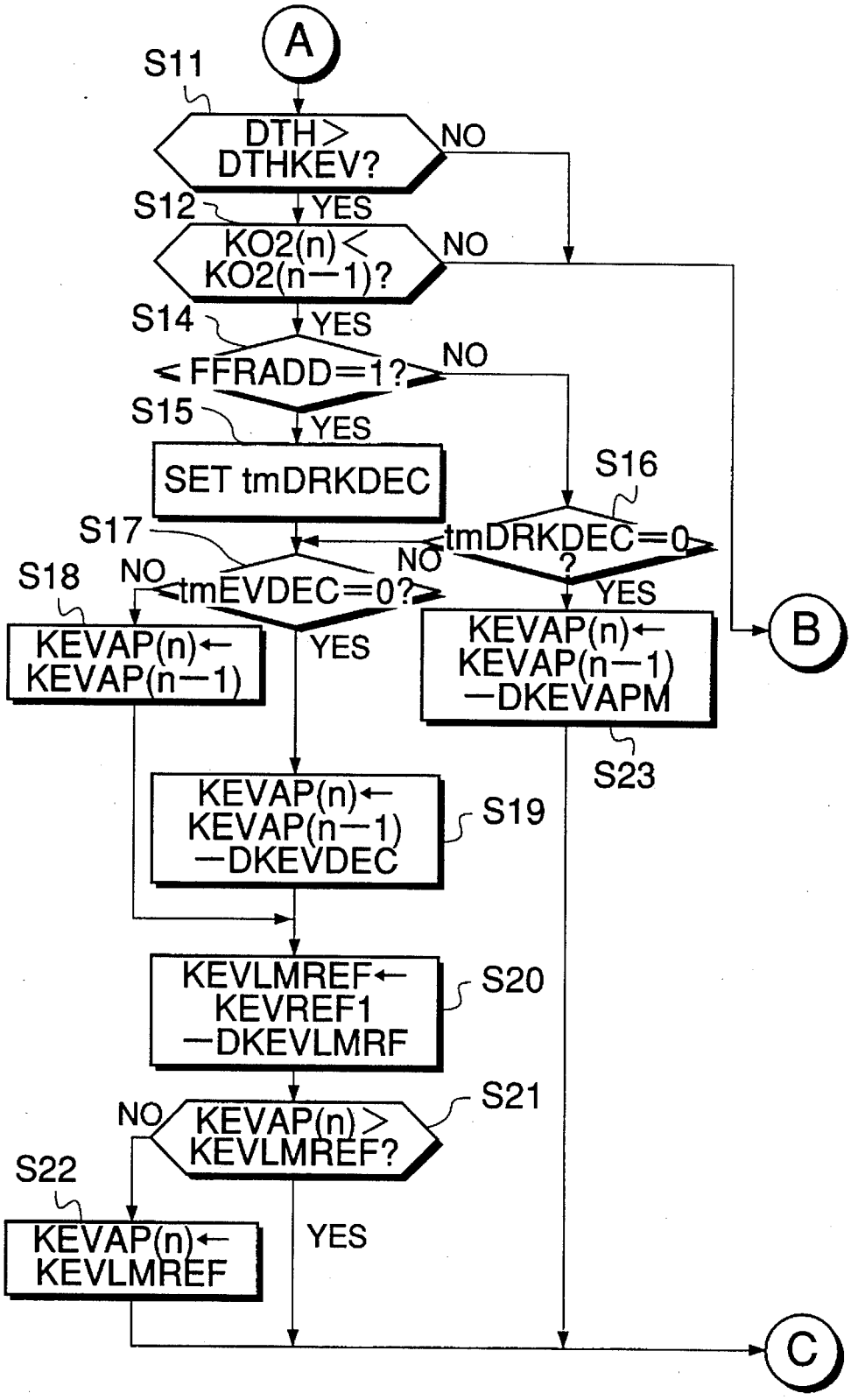

FIG. 2 shows a routine for calculating the evaporative fuel-dependent correction coefficient KEVAP, which is executed by the CPU during execution of the purging of evaporative fuel in synchronism with generation of each TDC signal pulse.

First, at a step S1, a higher reference value KO2EVH and a lower reference value KO2EVL of the air-fuel ratio correction coefficient KO2 are calculated by the use of the following equations (2) and (3):

$$KO2EVH=KREF+DKEVH \quad (2)$$

$$KO2EVL=KREF-DKEVL \quad (3)$$

where KREF represents a learned value of the air-fuel ratio correction coefficient KO2, DKEVH and DKEVL predetermined addend and subtrahend terms, respectively. The learned value KREF is calculated based on the air-fuel ratio correction coefficient KO2 obtained during the air-fuel ratio feedback control, and assumes various values depending on operating conditions of the engine. However, when the evaporative fuel-dependent correction coefficient KEVAP is below a predetermined value, it is judged that the influence of purging of evaporative fuel is too large to calculate the learned value KREF, so that the calculation of the learned value KREF is inhibited in this case.

At the following step S2, it is determined whether or not the air-fuel ratio correction coefficient KO2 is larger than the learned value KREF. If KO2>KREF holds, it is further determined at a step S3 whether or not the correction coefficient KO2 is larger than the higher reference value KO2EVH. If KO2 >KO2EVH, a higher value flag FKO2EVH is set to "1" and at the same time a lower value flag FKO2EVL is set to "0" at a step S5. Further, if KO2≦KO2EVH holds at the step S3, the higher and lower value flags FKO2EVH and FKO2EVL are both set to "0" at a step S6.

If KO2≦KREF holds at the step S2, it is further determined at a step S4 whether or not the correction coefficient KO2 is smaller than the lower reference value KO2EVL. If KO2≧KO2EVL holds, the program proceeds to the step S6, whereas if KO2 KO2EVL holds, the higher value flag FKO2EVH is set to "0" and at the same time the lower value flag FKO2EVL is set to "1" at a step S7.

After the step S5, S6 or S7 is executed, the program proceeds to a step S8, wherein it is determined whether or not the lower value flag FKO2EVL assumes "1". If FKO2EVL=0 holds, it is further determined at a step S9 whether or not the higher value flag FKO2EVH assumes "1".

If FKO2EVH=FKO2EVL=0 holds, and hence the air-fuel ratio correction coefficient KO2 is within a range defined by the higher reference value KO2EVH and the lower reference value KO2EVL, the program proceeds to a step S24, wherein the evaporative fuel-dependent correction coefficient KEVAP is held at the immediately preceding value (i.e. KEVAP(n)=KEVAP(n−1)), followed by terminating the program. It should be noted that a value of the correction coefficient KEVAP or KO2 having an affix (n) attached thereto represents the present value of the coefficient, while a value of the coefficient having an affix (n−1) attached thereto represent the immediately preceding value of the coefficient.

If FKO2VH=1 holds, which means that the air-fuel ratio correction coefficient KO2 is above the higher reference value KO2EVH, the program proceeds to a step S10, wherein it is determined whether or not the present value KO2(n) of the air-fuel ratio correction coefficient KO2 is larger than the immediately preceding value KO2(n−1) of the same. If KO2(n)≦KO2(n−1) holds, the program proceeds to the step S24, whereas if KO2(n)>KO2(n−1) holds, which means that the air-fuel ratio correction coefficient KO2 is increasing, the program proceeds to a step S25, wherein the evaporative fuel-dependent correction coefficient KEVAP is calculated by the use of the following equation (4):

$$KEVAP(n)=KEVAP(n-1)+DKEVAPP \quad (4)$$

where DKEVAPP represents a predetermined incremental value.

If FKO2EVL=1 holds at the step S8, the program proceeds to a step S11, wherein it is determined whether or not an amount of change DTH (the present value minus the immediately preceding value of the throttle valve opening θTH) is larger than a predetermined negative value DTHKEV. If DTH>DTHKEV holds, i.e. if the engine is accelerating or the amount of change of the throttle value θTH in a decreasing direction is small, it is further determined at a step S12 whether or not the present value KO2(n) of the air-fuel ratio correction coefficient KO2 is smaller than the immediately preceding value KO2(n−1) of the same. If DTH≦DTHKEV holds, which means that the amount of change of the throttle value θTH in the decreasing direction is large, or if KO2(n)≧KO2(n−1) holds, the program proceeds to the step S24.

On the other hand, if DTH>DTHKEV holds at the step S11, and at the same time, the air-fuel ratio correction coefficient KO2 is decreasing (KO2(n)<KO2(n−1)), it is determined at a step S14 whether or not an early stage flag FFRADD, which is set to "1" to indicate that the purging has just been started, assumes "1". If FFRADD=1 holds, which means that the purging has just been started, a down-counting timer tmDRKDEC is set to a predetermined time period TDRKDEC and started at a step S15. The timer tmDRKDEC measures a time period elapsed after the early stage flag FFRADD has changed from "1" to "0" (reference should be made to a step S16).

Figure 3:
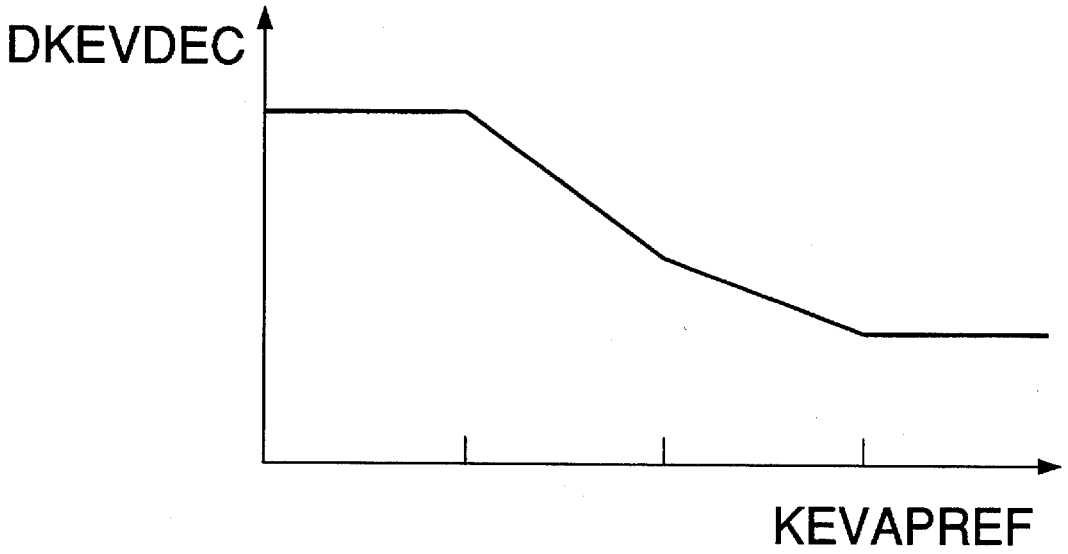
FIG. 3 shows a table for use in calculating a subtrahend term (DKEBDEC) applied to calculation of the evaporative fuel-dependent correction coefficient (KEVAP)

At the following step S17, it is determined whether or not a down-counting timer tmEVDECE is equal to "0". The timer tmEVDEC is set to a predetermined time period TEVDEC and started, so long as the purging is not executed. If tmEVDEC>0 holds, which means that the predetermined time period TEVDEC has not elapsed yet after the start of the purging, the evaporative fuel-dependent correction coefficient KEVAP is held at the immediately preceding value thereof at a step S18, and then the program proceeds to a step S20, whereas if tmEVDEC=0 holds, which means that the predetermined time period TEVDEC has elapsed after the start of the purging, the evaporative fuel-dependent correction coefficient KEVAP is calculated by the use of the following equation (5), followed by the program proceeding to the step S20.

$$KEVAP(n)=KEVAP(n-1)-DKEVDEC \quad (5)$$

where DKEVDEC represents a predetermined decremental value. The predetermined decremental value DKEVDEC is set, as shown in FIG. 3, according to a learned value KEVREF1 of the evaporative fuel-dependent correction coefficient KEVAP. The learned value KEVREF1 is calculated by a routine shown in FIG. 8. The predetermined decremental value DKEVDECE is set to a smaller value as the learned value KEVAPREF is larger.

Figure 8:
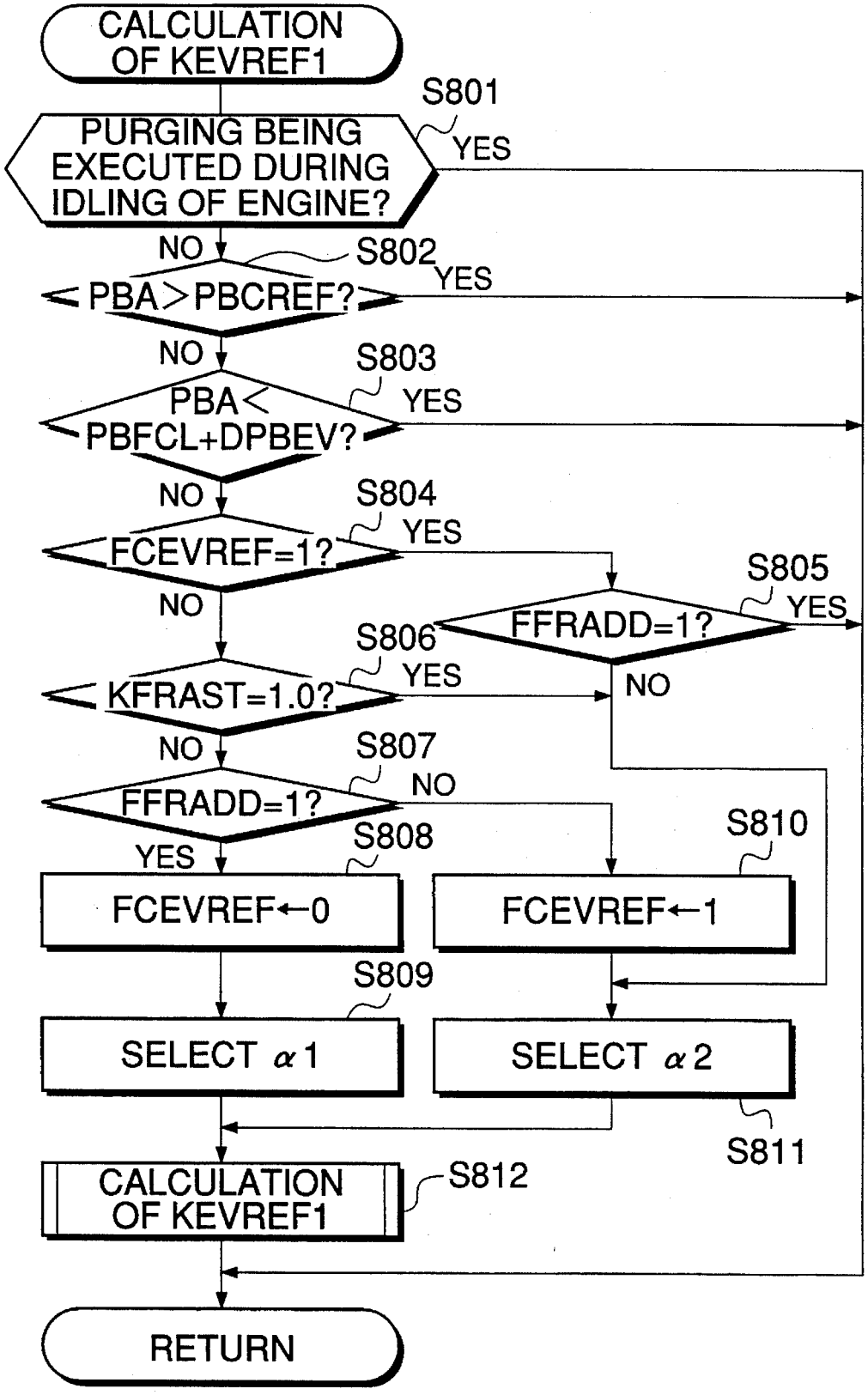
FIG. 8 is a flowchart showing a routine for calculating a learned value KEVREF1 of the evaporative fuel-dependent correction coefficient (KEVAP).

In the FIG. 8 routine, it is first determined at a step S801 whether or not the purging of evaporative fuel is being carried out during idling of the engine. If the answer to this question is affirmative (YES), the program is immediately terminated. If the answer to this question is negative (NO), the program proceeds to a step S802, wherein it is determined whether or not the intake absolute pressure PBA is higher than a predetermined value PBCREF (e.g. 610 mmHg). If PBA>PBCREF holds, the program is immediately terminated, whereas if PBA≦PBCREF, the program proceeds to a step S803, wherein it is determined whether the intake absolute pressure PBA is lower than the sum of a predetermined reference value PBFCL used in determining a fuel cut condition of the engine and a predetermined value DPBEV (e.g. 43 mmHg). If the answer to this question is affirmative (YES), the program is immediately terminated, whereas if the answer is negative (NO), the program proceeds to a step S804, wherein it is determined whether or not a flag FCEVREF assumes "1". As can be understood from the following steps, the flag FCEVREF is set to 1 when the early stage flag FFRADD no longer assumes "1" during purging of evaporative fuel executed immediately after the engine was started. If the answer to the question of the step S804 is affirmative (YES), the program proceeds to a step S805, wherein it is determined whether or not the early stage flag FFRADD assumes "1". If the answer to this question is affirmative (YES), i.e. if FFRADD=1 holds, the program is immediately terminated, whereas if the answer is negative (NO), the program proceeds to a step S811. On the other hand, if the answer to the question of the step S804 is negative (NO), the program proceeds to a step S806, wherein it is determined whether or not an after-start correction coefficient KFRAST is equal to 1.0. The after-start correction coefficient KFRAST is for correcting the duty factor of the duty control signal for the purge control valve 24, which is set such that it is progressively increased from 0 to 1.0. If KFRAST=1.0 holds at the step S806, the program proceeds to the step S811, whereas if KFRAST<1.0 holds, the program proceeds to a step S807, wherein it is determined whether or not the early stage flag FFRADD assumes "1". If the answer to this question is affirmative (YES), i.e. if FFRADD=1 holds, the program proceeds to a step S808, wherein the flag FCEVREF is set to "0", and then at a step S809, a predetermined value α1 is selected as a constant α used in calculating the learned value KEVREF1, followed by the program proceeding to a step S812. If the answer to the question of the step S807 is negative (NO), the program proceeds to a step S810, wherein the flag FCEVREF is set to "1", and then at the step S811, a predetermined value α2 (α2<α1) is selected as the constant α, followed by the program proceeding to the step S812. At the step S812, the learned value KEVREF1 of the evaporative fuel correction coefficient KEVAP is calculated by the following equation (6), followed by terminating the program:

$$KEVREF1=\alpha\times KEVAP+(1-\alpha)\times KEVREF1(n-1) \quad (6)$$

where KEVREF1(n−1) represents the immediately preceding value of the learned value KEVREF1.

Referring again to FIG. 2, at the step S20, an updating limit value KEVLMREF is calculated by the use of the following equation (7):

$$KEVLMREF=KEVREF1-DKEVLMRF \quad (7)$$

where DKEVLMRF represents a predetermined decremental value.

Then, at a step S21, it is determined whether or not the evaporative fuel-dependent correction coefficient KEVAP is larger than the updating limit value KEVLMREF. If KEVAP(n)>KEVLMREF holds, the present program is immediately terminated, whereas if KEVAP(n)≦KEVLMREF holds, the evaporative fuel-dependent correction coefficient KEVAP(n) is set to this updating limit value EVLMREF at a step S22, followed by terminating the program.

If FFRADD=0 subsequently holds at the step S14 (the early stage flag FFRADD is set to "1" upon starting of the purging, and reset to "0" when the duty factor of the duty control signal supplied to the purge control valve 24, which is progressively increased from 0, reaches a value corresponding to the operating condition of the engine), the program proceeds to a step S16, wherein it is determined whether or not the timer tmDRKEC set at the step S15 is equal to "0". If tmDRKDEC>0 holds, the program proceeds to the step S17, whereas if tmDRKDEC=0 holds, i.e. if the predetermined time period TDRKDEC has elapsed after the early stage flag FFRADD changed from "1" to "0", the program proceeds to a step S23, wherein the evaporative fuel-dependent correction coefficient KEVAP is calculated by the use of the following equation (8):

$$KEVAP(n)=KEVAP(n-1)-DKEVAPM \quad (8)$$

where DKEVAPM represents a predetermined decremental value.

According to the FIG. 2 processing described above, the evaporative fuel-dependent correction coefficient KEVAP is set based on the air-fuel ratio correction coefficient KO2 in the following manner:

1) If KO2EVH>KO2>KO2EVL or KO2>KO2EVH holds and at the same time the KO2 value is not increasing, or KO2<KO2EVL holds and at the same time the amount of change DTH of the throttle vale θTH is smaller than the predetermined negative value DTHKEV (the amount of change of the throttle valve opening in the decreasing direction is large), or KO2<KO2EVL holds and at the same time KO2 value is not decreasing, the evaporative fuel-dependent correction coefficient KEVAP is held at the immediately preceding value (at the step S24).

2) If KO2>KO2EVH holds and at the same time KO2 value is increasing, the evaporative fuel-dependent correction coefficient KEVAP is set in a progressively increasing manner.

3) If KO2<KO2EVL and DTH>DTHKEV hold and at the same time KO2 value is decreasing, the evaporative fuel-dependent correction coefficient KEVAP is set in a progressively decreasing manner (at the step S19 or S23). However, within the predetermined time period after the start of the purging, the correction coefficient KEVAP is held at the immediately preceding value (at the step S18), and further, at an early stage of the purging, the correction coefficient KEVAP is set such that it does not fall below the updating limit value KEVLMREF (at the step S22).

Figure 4:
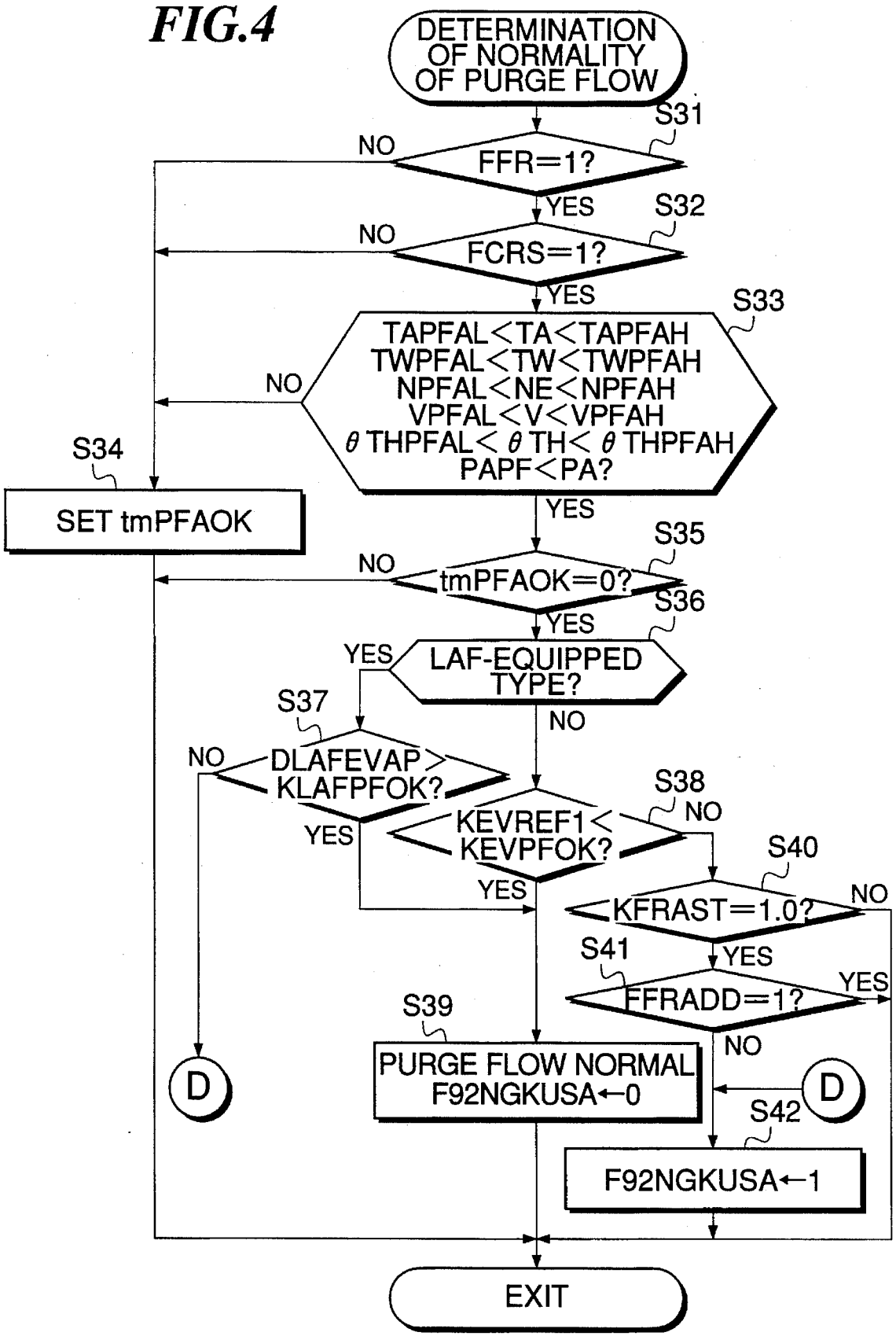
FIG. 4 is a flowchart showing a routine for determining normality of a flow of purged evaporative fuel (purge flow)

FIG. 4 shows a routine for determining normality of purge flow of the evaporative emission control system, which is executed by the CPU in synchronism with generation of each TDC signal pulse.

First, at a step S31, it is determined whether or not a flag FFR, which is set to "1" to indicate that the purging of evaporative fuel is being executed, assumes "1". If FFR=1 holds, it is determined at a step S32 whether or not a flag FCRS, which is set to "1" to indicate that the vehicle on which the engine is installed is cruising, assumes "1". The flag FCRS is set to "1" when the engine is in a steady operating condition and the vehicle is traveling at a substantially constant speed.

If FCRS=1 holds, which means that the vehicle is cruising, the program proceeds to a step S33, wherein it is further determined whether or not the intake air temperature TA is within a range defined by a predetermined upper limit value TAPFAH (e.g. 89° C.) and a predetermined lower limit value TAPFAL (e.g. −10° C.), whether or not the engine coolant temperature TW is within a range defined by a predetermined upper limit value TWPFAH (e.g. 89° C.) and a predetermined lower limit value TWPFAL (e.g. 47° C.), whether or not the engine rotational speed NE is within a range defined by a predetermined upper limit value NPFAH (e.g. 4000 rpm) and a predetermined lower limit value NPFAL (e.g. 1000 rpm), whether not the vehicle speed V is within a range defined by a predetermined upper limit value VPFAH (e.g. 110 km/h) and a predetermined lower limit value VPFAL (e.g. 10 km/h), whether or not the throttle valve opening θTH is within a range defined by a predetermined upper limit value θTHPFAH (e.g. 40 degrees) and a predetermined lower limit value θTHPFAL (e.g. 2.5 degrees), and whether or not atmospheric pressure PA is higher than a predetermined value PAPF (e.g. 435 mmHg).

If any of the answers to the questions of the steps S31 to S33 is negative (NO), a down-counting timer tmPFAOK is set to a predetermined time period TPFAOK (e.g. 3 seconds) and started at a step S34, followed by terminating the program. Further, if all the answers to the questions of the steps S31 to S33 are affirmative (YES), it is determined at a step S35 whether or not the count of the down-counting timer tmPFAOK is equal to "0". When this question is first made, tmPFAOK>0 holds, and hence the program is immediately terminated, whereas when tmPFAOK=0 holds, the normality-determining processing is executed at a step S36 et seq.

At the step S36, it is determined whether or not the engine 1 is equipped with "a LAF sensor (linear output air-fuel ratio sensor)", i.e. whether a LAF sensor (not used in the present embodiment), which delivers an output proportional to the concentration of oxygen contained in exhaust gases, is used in the engine as the oxygen concentration sensor 16. If the engine is not equipped with the LAF sensor, in other words, if the O2 sensor 16 is used in the engine as the oxygen concentration sensor, which delivers a high or low i.e. a binary signal depending on the concentration of oxygen contained in exhaust gases, as in the present embodiment, it is determined at a step S38 whether or not the learned value KEVREF1 of the evaporative fuel-dependent correction coefficient KEVAP is smaller than a predetermined determining value KEVPFOK. If KEVREF1 <KEVPFOK holds, which means that the learned value KEVREF1 of the evaporative fuel-dependent correction coefficient KEVAP has decreased to a predetermined extent or more due to the purging of evaporative fuel, it is judged that the purge flow is normal, and an abnormality possibility flag F92NGKUSA, which is set to "1" when there is a possibility of abnormality of the purge flow, is set to "0" at a step S39, followed by terminating the program.

On the other hand, if KEVREF1≧KEVPFOK holds, which means that the learned value KEVREF1 of the evaporative fuel-dependent correction coefficient KEVAP has not decreased to the predetermined extent in spite of execution of the purging, it is determined at a step S40 whether or not the after-start correction coefficient KFRAST is equal to 1.0 (non-corrective value). If KFRAST=1.0 holds at the step S40, it is further determined at a step S41 whether or not the early stage flag FFRADD is equal to "1".

If KFRAST<1.0 or FFRADD=1 holds, which means that the purging has just been started, the determination is made pending, followed by immediately terminating the program, whereas if KFRAST=1.0 and at the same time FFRADD=0 hold, there is a possibility of abnormality of the purge flow, so that the abnormality possibility flag F92NGKUSA is set to "1" at a step S42, followed by terminating the program.

Further, if it is determined at the step S36 that the engine 1 is the LAF sensor-equipped type, it is determined at a step S37 whether or not the amount of change DLAFEVAP (=KREF−KLAF) in the air-fuel ratio correction coefficient as a difference between an average value KREF of an air-fuel ratio correction coefficient KLAF for the LAF sensor-equipped type engine (which corresponds to the correction coefficient KO2 in the present embodiment) and the air-fuel ratio correction coefficient KLAF is larger than a predetermined determining value KLAFPFOK. If DLAFEVAP>KLAFPFOK holds, it means that the air-fuel ratio has become enriched by the purged evaporative fuel, resulting in a decrease in the correction coefficient KLAF by a predetermined amount or more, so that the program proceeds to the step S39 to determine that the purge flow is normal. On the other hand, if DLAFEVAP≦KLAFPFOK holds, the program proceeds to the step S42 to set the abnormality possibility flag F92NGKUSA to "1".

According to the FIG. 4 processing described above, if during execution of purging of evaporative fuel, the learned value KEVREF1 of the evaporative fuel-dependent correction coefficient KEVAP has decreased below the predetermined determining value KEVPFOK under a predetermined operating condition of the engine, or the amount of change DLAFEVAPGA is larger than the predetermined determining value KLAFPFOK, it is determined that the purge flow is normal. This dispenses with the use of a vacuum switch required by the prior art, and enables the normality determination to be quickly carried out in a simplified manner.

The reason why even if KEVREF1≧KEVPFOK is fulfilled at the step S38 (or DLAFEVAP≦KLAFPFOK is fulfilled at the step S37), it is not determined that the purge flow is abnormal is that when the concentration of the purged evaporative fuel is low, the amount of change in the learned value of the evaporative fuel-dependent correction coefficient KEVREF1 (or the air-fuel ratio correction coefficient KLAF) is small even if the purging passage and other component parts of the system are not faulty.

Figure 5A:
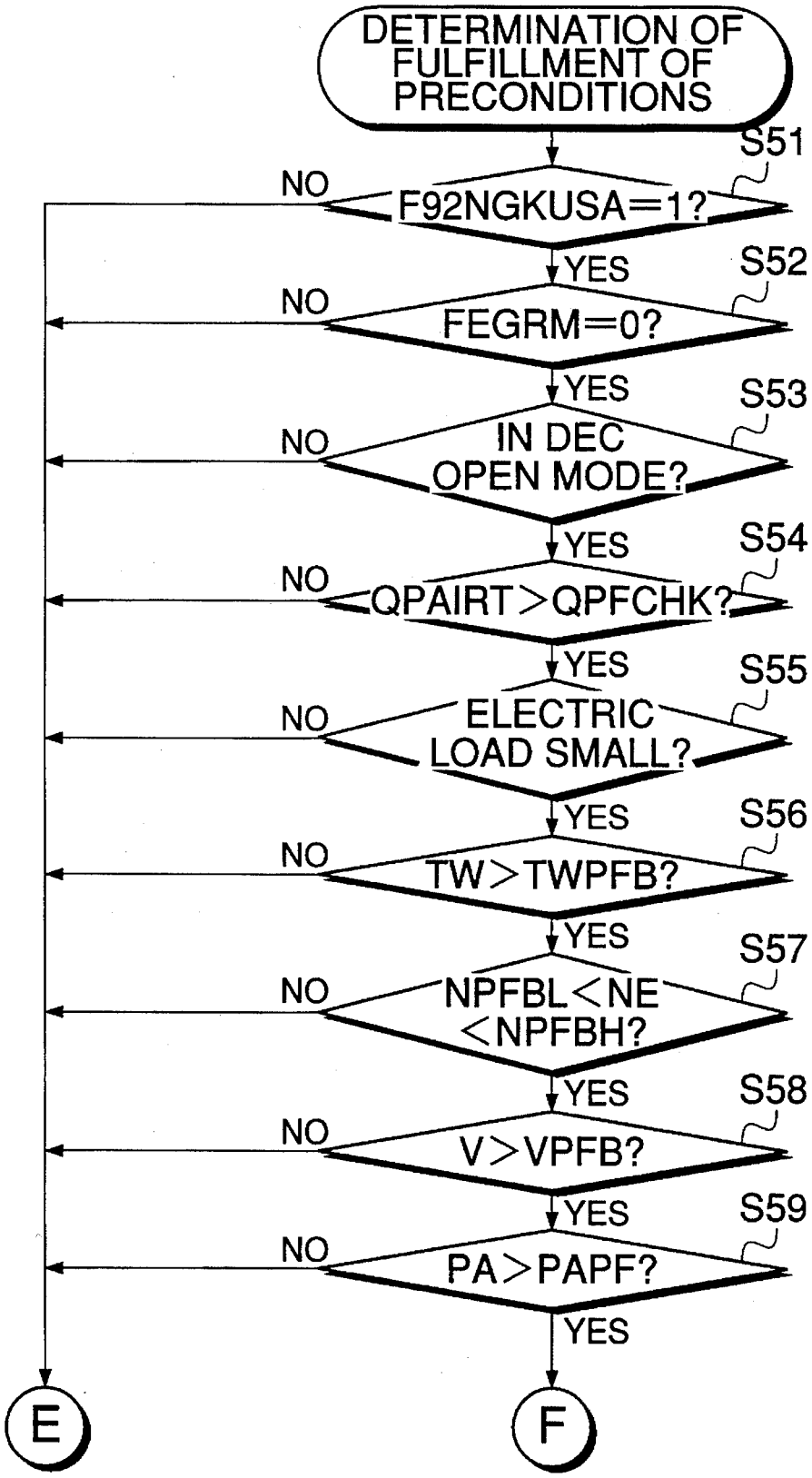
FIG. 5 is a flowchart showing a routine for determining whether preconditions are satisfied for determining abnormality of the purge flow.
Figure 5B:
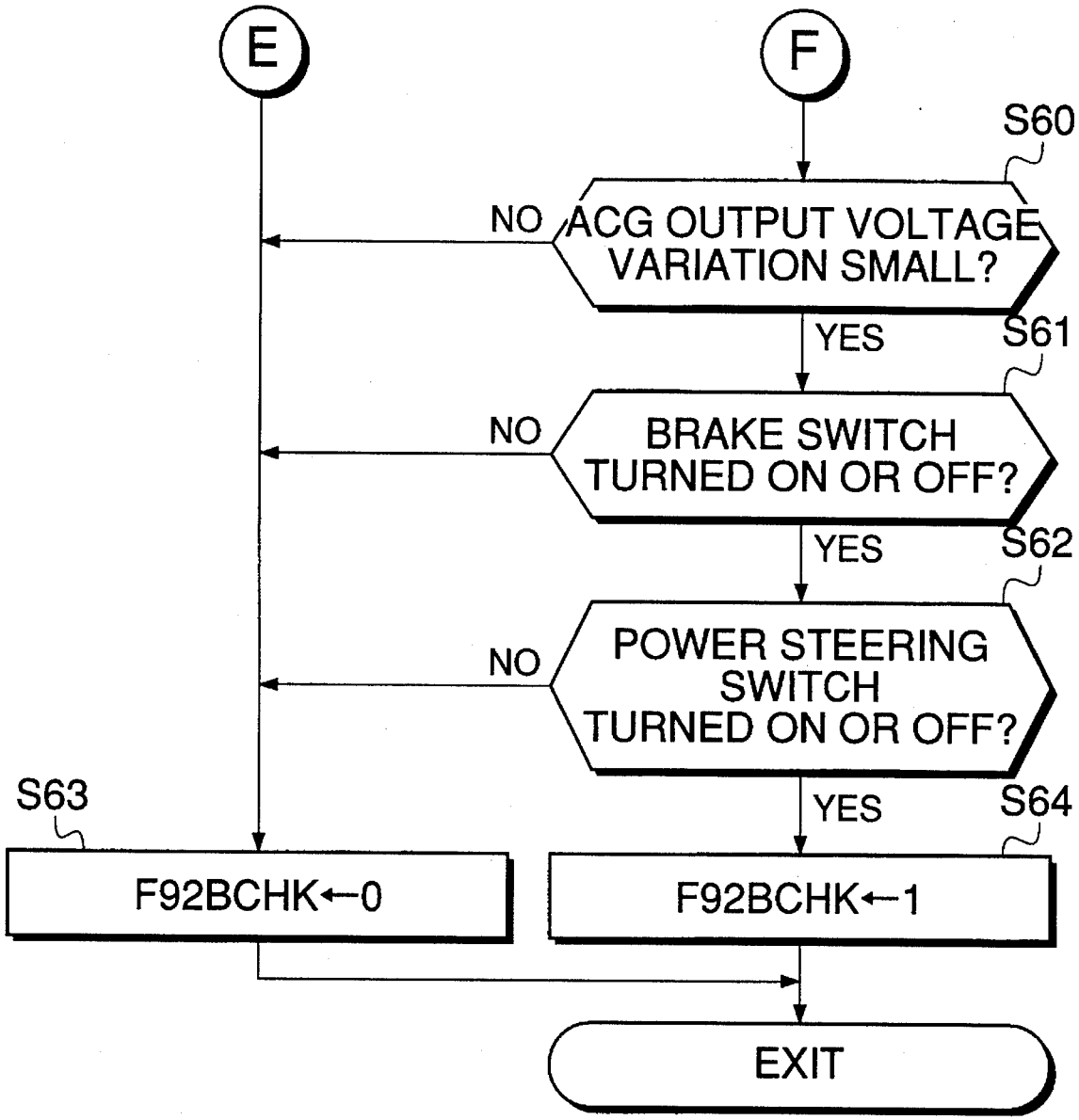

FIG. 5 shows a routine for determining whether preconditions are fulfilled for carrying out the determination of abnormality of the purge flow by a routine described hereinbelow with reference to FIG. 6. The FIG. 5 processing is executed by the CPU in synchronism with generation of each TDC signal pulse.

First, at a step S51, it is determined whether or not the abnormality possibility flag F92NGKUSA assumes "1". If F92NGKUSA=1 holds, a flag FEGRAM, which is set to "1" to indicate that monitoring of the exhaust recirculation (checking as to abnormality of the EGR system) is being executed, assumes "0". If FEGRM=0 holds it is determined at a step S53 whether or not the engine is operating in a deceleration open mode in which the air-fuel ratio control is carried out in open control mode. The deceleration open mode is defined as an operating condition of the engine in which the engine 1 is supplied with a decelerating secondary air but not supplied with fuel. The decelerating secondary air is supplied into the intake pipe 2 via a bypass passage, not shown, which bypasses the throttle valve 4.

If the engine is determined to be in the decelerating open mode at the step S53, it is determined at a step S54 whether or not a cumulative value QPAIRT of the purged gas (calculated by accumulating the value of flow rate of purged gas calculated based on the valve opening of the purge control valve 24 and differential pressure (=PA−PBA) between the atmospheric pressure PA and the intake pipe absolute pressure PBA since the engine was started) is larger than a predetermined value QPFCHK. If QPAIRT>QPFCHK holds, it is further determined at a step 55 whether or not an electric load on a battery, not shown, which is installed in the engine, is smaller than a predetermined value. If the electric load on the battery is smaller that the predetermined value, it is determined at a step S56 whether or not the engine coolant temperature TW is higher than a predetermined value TWPFB (e.g. 75° C.). If TW>TWPFB holds, it is determined at a step S57 whether or not the engine rotational speed NE is within a range defined by a predetermined upper limit value NPFBH (e.g. 2500 rpm) and a predetermined lower limit value NPFBL (e.g. 1000 rpm). If NPFBL<NE<NPFBH holds, it is determined at a step S58 whether or not the vehicle speed V is higher than a predetermined value VPFB (e.g. 15 km/h). If V>VPFB holds, it is determined at a step S59 whether or not the atmospheric pressure PA is higher than a predetermined value PAPF (e.g. 435 mmHg). If PA>PAPF holds, it is determined at a step S60 whether or not the output voltage of a generator, not shown, driven by the engine 1 has a variation thereof smaller than a predetermined level. If the variation in the output voltage of the generator is below the predetermined level, it is determined at a step S61 whether or not the ON/OFF state of a brake switch, not shown, of the vehicle has been changed (i.e. whether the brake switch has been turned on or off). If the ON/OFF state of the brake switch has not been changed, it is determined at a step S62 whether or not the ON/OFF state of a power steering switch, not shown, of the vehicle has been changed (i.e. whether the power steering switch has been turned on or off).

If any of the answers to the questions of the steps S51 to S60 is negative (NO), or the answer to the question of the step S61 or S62 is affirmative (YES), it is determined that the preconditions are not satisfied, and then the program proceeds to a step S63, wherein a preconditions flag F92BCHK is set to "0", whereas if all the answers to the questions of the steps S51 to S60 are affirmative (YES) and at the same time both the answers to the questions of the steps S61 and S62 are negative (NO), it is determined that the preconditions are satisfied, and then the program proceeds to a step S64, wherein the preconditions flag F92BCHK is set to "1".

Figure 6A:
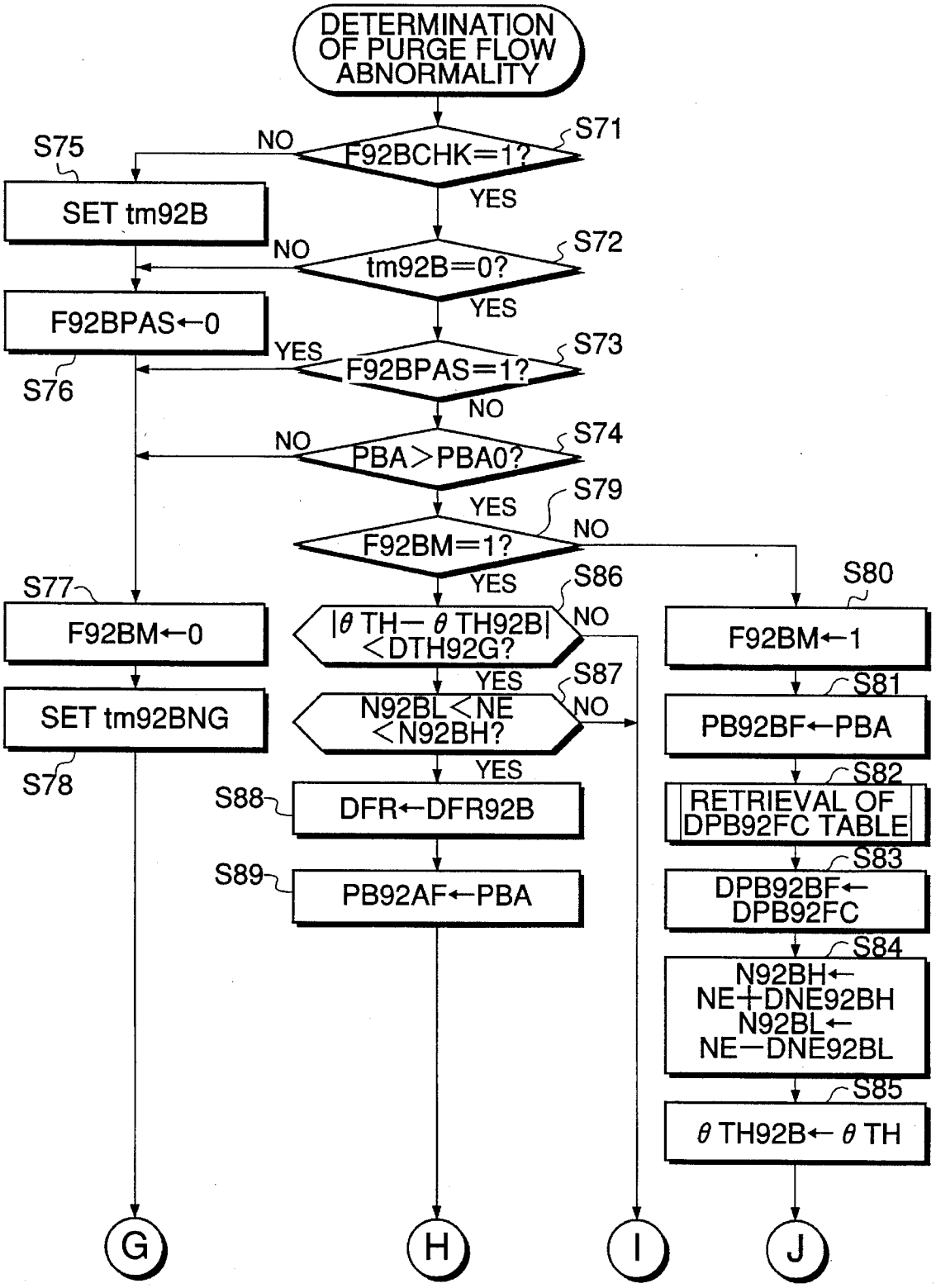
FIG. 6 is a flowchart showing a routine for determining abnormality of the purge flow.
Figure 6B:
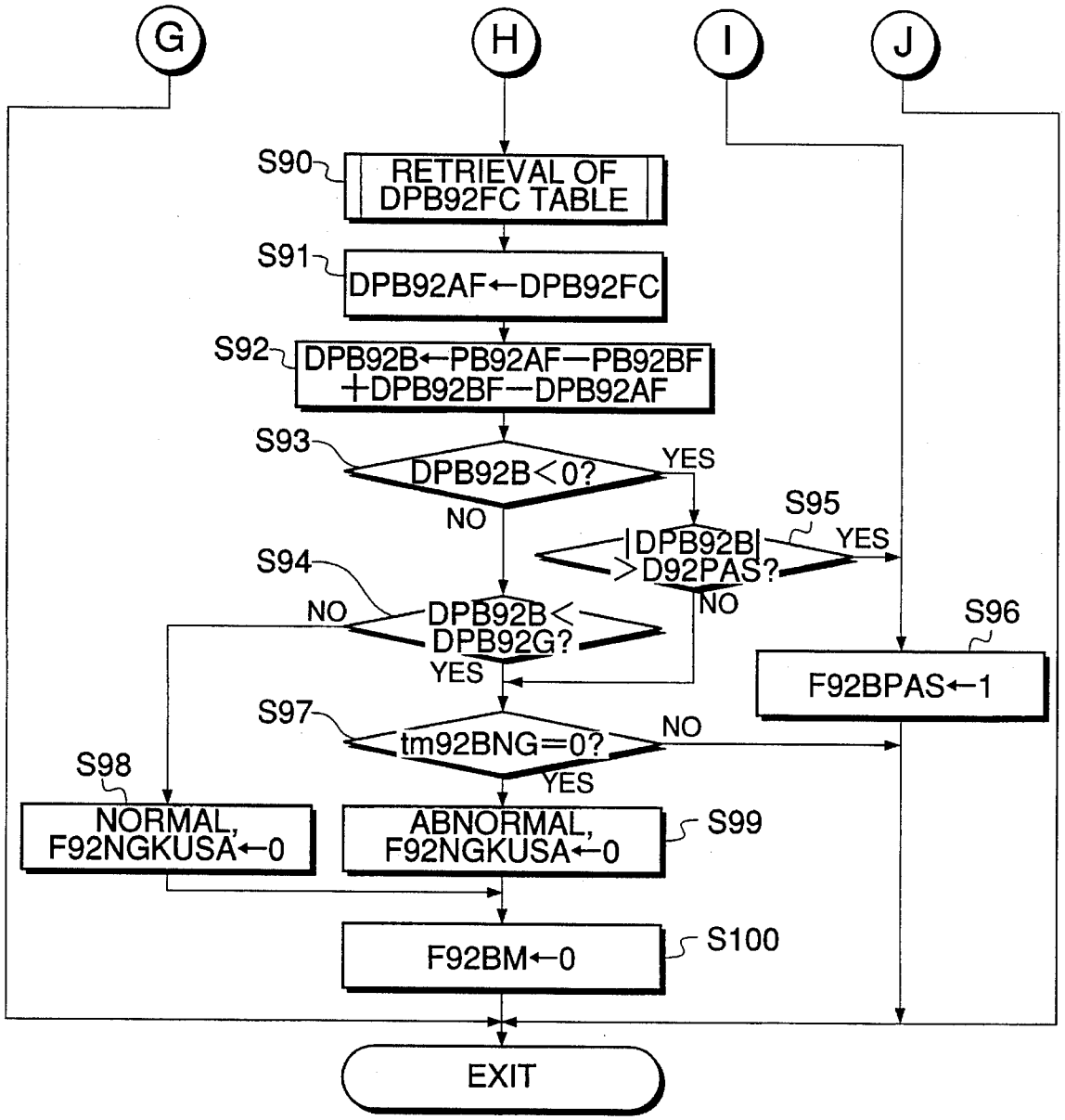

FIG. 6 shows the aforementioned routine for determining abnormality of the purge flow resulting from a faulty component part of the evaporative emission control system, based on the intake pipe absolute pressure PBA. This routine is executed by the CPU of the ECU 6 in synchronism with generation of each TDC signal pulse.

First, at a step S71, it is determined whether or not the preconditions flag F92BCHK set by the FIG. 5 routine assumes "1" If F92BCHK=0 holds a down-counting timer tm92B is set to a predetermined time period T92B (e.g. 1 second) and started at a step S75, a suspension flag F92BPAS, which is set to "1" to indicate that the abnormality determination by the present routine is suspended, is reset to "0" at a step S76, further a monitoring execution flag F92BM, which is set to "1" to indicate that the abnormality determination by the present routine is being executed, is reset to "0" at a step S77, and a down-counting timer tm92BNG is set to a predetermined time period T92BNG (e.g. 1 second) and started at a step S78, followed by terminating the program. The timer tm92B is provided to determine whether or not the predetermined time period T92B has elapsed after the preconditions are satisfied (refer to a step S72), while the timer tm92BNG measures a delay time period, i.e. the predetermined time period T92BNG before it is definitely determined that the purge flow is abnormal (refer to a step S97).

If F92BCHK=1 holds at the step S71, it is determined at the step S72 whether or not the count of the timer tm92B is equal to "0". When this question is first made, tm92B >0 holds so that the program proceeds to the step S76. When tm92B=0 is subsequently fulfilled, the program proceeds from the step S72 to a step S73, wherein it is determined whether or not the suspension flag F92BPAS assumes "1". If F92BPA=0 holds it is further determined at a step S74 whether or not the intake air absolute pressure PBA is higher than a predetermined value PBA0 (e.g. 50 mmHg). If F92BPAS=1 holds at the step S73, which means that the abnormality determination is suspended, or if PBA≦PBA0 holds the program proceeds to the step S77, whereas if PBA>PBA0 holds the program proceeds to a step S79, wherein it is determined whether or not the monitoring execution flag F92BM assumes "1".

Figure 7A:
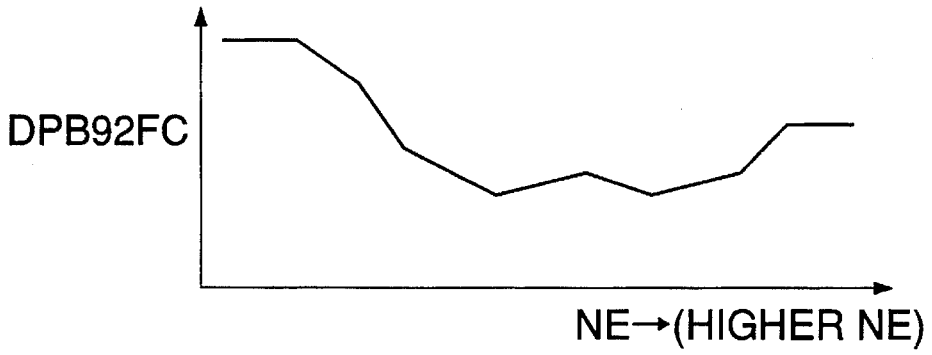
FIG. 7A shows a table for use in calculating a correction term (DPB92FC) for correcting an intake pipe absolute pressure (PBA) value.

When the question at the step S79 is first made, F92BM=0 holds so that the following steps S80 to S85 are executed. First, the monitoring execution flag F92BM is set to "1" at the step S80, the intake pipe absolute pressure PBA is stored as an initial pressure value PB92BF at the step S81, a correction term DPB92FC for correcting the intake pipe absolute pressure PBA is determined by retrieving a DPB92FC table, which is set e.g. as shown in FIG. 7A, according to the engine rotational speed NE at the step S82, the calculated correction term DPB92FC is stored as an initial correction term value DPB92BF at the step S83, an upper determining value N92BH and a lower determining value N92BL of the engine rotational speed NE are calculated by the following equations (9) and (10) at the step S84, and the throttle valve opening θTH is stored as an initial opening value θTH92B at the step S85, followed by terminating the program:

$$N92BH=NE+DNE92BH \quad (9)$$

$$N92\ BL=NE-DNE92BL \quad (10)$$

where DNE92BH and DNE92BL represent predetermined engine rotational speed values, both set e.g. to 200 rpm.

When the program proceeds to the step S79 in the following loop, since F92BM=1 is fulfilled on this occasion, the program proceeds to a step S86, wherein it is determined whether or not the absolute value |θTH −θTH92B| of an amount of change of the throttle valve opening θTH from the initial opening value θTH92B thereof is smaller than a predetermined value DTH92G (e.g. 0.3 degrees). If the answer to this question is affirmative (YES), it is further determined at a step S87 whether or not the engine rotational speed NE is within a range defined by the upper determining value N92BH and the lower determining value N92BL. If the answer to the question of the step S86 or S87 is negative (NO), which means that the change in the operating condition of the engine is large, the program proceeds to a step S96, wherein the suspension flag F92BPAS is set to "1", followed by terminating the program.

If the answers to the questions of the steps S86 and S87 are both affirmative (YES), which means that the change in the operating condition of the engine is small, the duty factor DFR of the duty control signal for the purge control valve 24 is set to a predetermined value DFR92B corresponding to a fully-opened state of the purge control valve 24 at a step S88, and the intake pipe absolute pressure PBA is stored as the present PBA value PB92AF at a step S89. Then, the DPB92FC table is retrieved similarly to the step S82 to determine the correction term DPB92FC at a step S90, and the determined correction term DPB92FC is stored as the present correction term DPB92AF at a step S91.

At the following step S92, the amount of change DPB92G in the intake pipe absolute pressure PBA is calculated by the following equation (11):

$$DPB92G=PB92AF-PB92BF+DPB92BF-DPB92AF \quad (11)$$

According to the above equation (11), the amount of change in the intake pipe absolute pressure PBA is calculated through correction of the same by the use of correction terms DPB92BF and DPB92AF set according to the engine rotational speed NE.

Figure 7B:
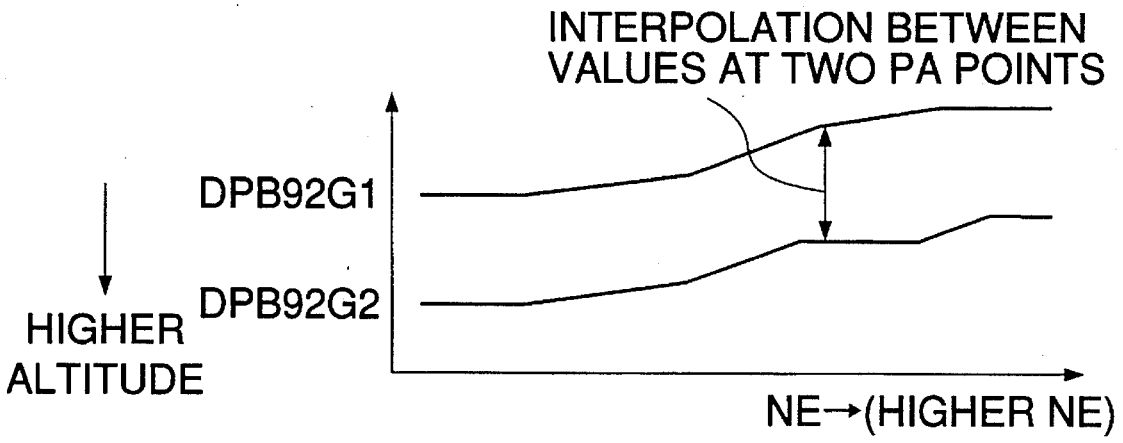
FIG. 7B shows a table for use in calculating a predetermined amount of change (DPB92G) in the intake pipe absolute pressure (PBA)

At the following step S93, it is determined whether or not the amount of change DPB92B has a negative value. If it does not have a negative value, it is further determined at a step S94 whether or not the amount of change DPB92B is smaller than a predetermined value DPB92G. The predetermined value DPB92G is determined by retrieving a DPB92G table set as shown in FIG. 7B according to the engine rotational speed NE and the intake pipe absolute pressure PBA. In retrieving the DPB92B table, a value DPB92G1 for a low altitude and a value DPB92G2 for a high altitude are determined according to the engine rotational speed NE, and then an interpolation is carried out on the two values thus obtained according to the atmospheric pressure detected, to thereby determine the predetermined value DPB92G.

If both the answers to the questions of the steps S93 and S94 are negative (NO), i.e. if the intake pipe absolute pressure PBA has increased by the predetermined value DPB92G or more as a result of the purge control valve being fully opened, it is determined that the purge flow is normal, so that the abnormality possibility flag F92NGKUSA is reset to "0" at the step S98.

If the answer to the question of the step S93 is negative (NO) and at the same time the answer to the question of the step S94 is affirmative (YES), i.e. the intake pipe absolute pressure PBA is increasing and at the same time the amount of increase is smaller than the predetermined value DPB92G, it is determined at a step S97 whether or not the count of the timer tm92BNG started at the step S78 is equal to "0". When this question is first made, tm92BNG>0 holds and then the present program is immediately terminated, whereas when tm92BNG=0 is fulfilled after the lapse of the predetermined time period tm92BNG, it is determined that the purge flow is abnormal, thereby setting the abnormality possibility flag F92NGKUSA to "0"

If DPB92B<0 holds at the step S93, it is determined at a step S95 whether or not the absolute value |DPB92B| thereof is larger than a predetermined value D92PAS. If the answer to this question is affirmative (YES), which means that the intake pipe absolute pressure PBA has decreased by the predetermined value or more, the program proceeds to the step S96, thereby setting the suspension flag F92BPAS to "1", followed by terminating the present program.

If |DPB92B|≦D92PAS holds at the step S95, i.e. if the amount of decrease |DPB92B| in the intake pipe absolute pressure PBA is smaller than the predetermined value D92PAS, the program proceeds to the step S97.

If the determination at the step S98 or S99 has been made, the monitoring execution flag F92BM is reset to "0" at a step S100, followed by terminating the program.

According to the present processing described above, under the predetermined operating condition of the engine, the purge control valve 24 is fully opened, and then whether the purge flow is normal or abnormal is determined based on the amount of change DPB92B in the intake pipe absolute pressure PBA in the following manner:

1) It is determined that the purge flow is normal, when the intake pipe absolute pressure PBA has increased by the predetermined value DPB92G or more (at the step S98).

2) It is determined that the purge flow is abnormal, when the amount of increase in the intake pipe absolute pressure PBA is smaller than the predetermined value DPB92G or when the amount of increase in the intake pipe absolute pressure PBA has continued to be smaller than the predetermined value D92PAS for more than the predetermined time period T92BN5G (at the step S97).

It should be noted that the FIG. 6 processing is executed under a very limited operating condition of the engine. Therefore, the normality determination of the purge flow is mainly carried out by the FIG. 4 processing, while the FIG. 6 processing carries out abnormality determination of the purge flow which cannot be definitely made by the FIG. 4 processing. This makes it possible to determine abnormality of the purge flow without using a vacuum switch which is required by the prior art.

As described heretofore, according to the present embodiment of the invention, a combination of the FIG. 4 processing (determination based on a change in the evaporative fuel-dependent correction coefficient KEVAP) and the FIG. 6 processing (determination based on a change in the intake pipe absolute pressure PBA) makes it possible to determine normality and abnormality of the purge flow and hence those of the evaporative emission control system without using a vacuum switch, which contributes to reduction of the manufacturing cost and improvement in the reliability through simplification of the system. Further, it is possible to determine the normality of the purge flow in a shorter time period when the system is normal.

What is claimed is:

1. In an evaporative emission control system for an internal combustion engine having a fuel tank, an intake passage, a throttle valve arranged in said intake passage, an exhaust passage, an exhaust gas component concentration sensor arranged in said exhaust passage for detecting concentration of a component in exhaust gases emitted from said engine, air-fuel ratio control means for controlling an air-fuel ratio of a mixture supplied to said engine by the use of an air-fuel ratio correction coefficient determined in response to an output from said exhaust gas component concentration sensor, said evaporative emission control system including a canister for adsorbing evaporative fuel generated from said fuel tank, a purging passage connecting between said canister and said intake passage at a location downstream of said throttle valve, and a purge control valve arranged in said purging passage for controlling a flow rate of purged gases containing evaporative fuel to be supplied from said canister via said purging passage into said intake passage, the improvement comprising determining means for determining whether said evaporative fuel emission control system is normal or abnormal, from a change in a value of a parameter depending upon said output from said exhaust gas component concentration sensor detected when an opening of said purge control valve is changed and a change in pressure within said intake passage at a location downstream of said throttle valve when said opening of said purge control valve is changed.

2. An evaporative fuel emission control system according to claim 1, wherein said exhaust gas component concentration sensor is an O2 sensor which generates a binary signal in response to concentration of oxygen present in said exhaust gases, said parameter being an evaporative fuel-dependent correction coefficient having a value thereof set in dependence on said air-fuel ratio correction coefficient for correcting said air-fuel ratio correction coefficient to compensate for influence of purging of said evaporative fuel on said air-fuel ratio correction coefficient.

3. An evaporative fuel emission control system according to claim 2, wherein said determining means determines that said evaporative emission control system is normal when said evaporative fuel-dependent correction coefficient is smaller than a predetermined reference value when said engine is in a predetermined operating condition.

4. An evaporative fuel emission control system according to claim 3, wherein said evaporative fuel-dependent correction coefficient is progressively decreased when a present value of said air-fuel ratio correction coefficient is smaller than a predetermined value smaller than a learned value of said air-fuel ratio correction coefficient, a change in an opening of said throttle valve is larger than a predetermined negative value, and at the same time a present value of said air-fuel ratio correction coefficient is decreasing.

5. An evaporative fuel emission control system according to claim 4, wherein said evaporative fuel-dependent correction coefficient is set such that it does not become smaller than a predetermined lower limit value before a predetermined time period elapses after said purging of evaporative fuel is started.

6. An evaporative fuel emission control system according to claim 1, wherein said exhaust gas component concentration sensor is a linear output air-fuel ratio sensor which generates an output signal proportional to concentration of oxygen present in said exhaust gases, said parameter being a difference between a present value of said air-fuel ratio correction coefficient and an average value of said air-fuel ratio correction coefficient.

7. An evaporative fuel emission control system according to claim 6, wherein said determining means determines that said evaporative emission control system is normal when said difference between the present value of said air-fuel ratio correction coefficient and the average value of said air-fuel ratio correction coefficient is larger than a predetermined reference value when said engine is in a predetermined operating condition during purging of said purged gases through said purge control valve.

8. An evaporative fuel emission control system according to claim 1, wherein said determining means determines that said evaporative emission control system is normal when said pressure within said intake passage has increased by a predetermined amount or more, after said purge control valve was fully opened when said engine is in a predetermined operating condition.

9. An evaporative fuel emission control system according to claim 1, wherein said determining means determines that said evaporative emission control system is abnormal when said pressure within said intake passage has not increased by a predetermined amount or more, within a predetermined time period after said purge control valve was fully opened when said engine is in a predetermined operating condition.

10. An evaporative fuel emission control system according to claim 1, wherein said determining means inhibits execution of determination of abnormality of said evaporative emission control system when said pressure within said intake passage has decreased by a predetermined amount or more, after said purge control valve was fully opened when said engine is in a predetermined operating condition.

* * * * *